US005164534A

United States Patent [19]

Royster

[11] Patent Number: 5,164,534

[45] Date of Patent: Nov. 17, 1992

[54] SECONDARY RECOIL ABSORPTION MECHANISM FOR USE ON A FIREARM

[76] Inventor: John L. Royster, 7660 E. Warren Cir., Denver, Colo. 80231

[21] Appl. No.: 839,670

[22] Filed: Feb. 19, 1992

Related U.S. Application Data

[63] Continuation of Ser. No. 669,948, Mar. 15, 1991, abandoned, which is a continuation-in-part of Ser. No. 542,007, Jun. 22, 1990, which is a continuation-in-part of Ser. No. 161,195, Feb. 6, 1988, Pat. No. 4,938,116, which is a continuation-in-part of Ser. No. 40,129, Apr. 20, 1987, abandoned.

[51] Int. Cl.[5] ..... F41A 3/38

[52] U.S. Cl. ..... 89/1.4; 89/180; 89/199

[58] Field of Search ..... 89/1.4, 180, 199, 194, 89/195, 197

[56] References Cited

U.S. PATENT DOCUMENTS

| | | | |
|---|---|---|---|
| 993,175 | 5/1911 | Knotgen | 89/190 |
| 1,625,993 | 4/1927 | Gouton | 89/1.4 |
| 2,751,820 | 6/1956 | Pope | 89/197 |
| 3,661,049 | 5/1972 | Perrine | 89/199 |
| 4,358,986 | 11/1982 | Giorgio | 89/199 |
| 4,719,841 | 1/1988 | Perrine | 89/1.4 |
| 4,938,116 | 7/1990 | Royster | 89/197 |

FOREIGN PATENT DOCUMENTS

| | | | |
|---|---|---|---|
| 10301 | of 1895 | United Kingdom | 89/197 |
| 134623 | of 1919 | United Kingdom | 89/199 |

*Primary Examiner*—Stephen M. Johnson
*Attorney, Agent, or Firm*—Terry M. Gernstein

[57] ABSTRACT

A secondary recoil absorption mechanism absorbs some of the recoil energy associated with the firing of the firearm. The secondary recoil absorption mechanism includes a roller mounted on the breech block to engage a ramp element pivotally mounted on the frame of the firearm. The ramp element includes a rounded corner against which the roller abuts. The ramp element is connected to a cocking lever by a roller mounted in a guide groove defined on a cocking lever. The cocking lever is moved manually to move the ramp rounded corner out of the path of movement of the breech block mounted roller and to move the breech block into a cocked position held behind a sear. The guide groove includes a plurality of sections.

14 Claims, 4 Drawing Sheets

FIG. 2
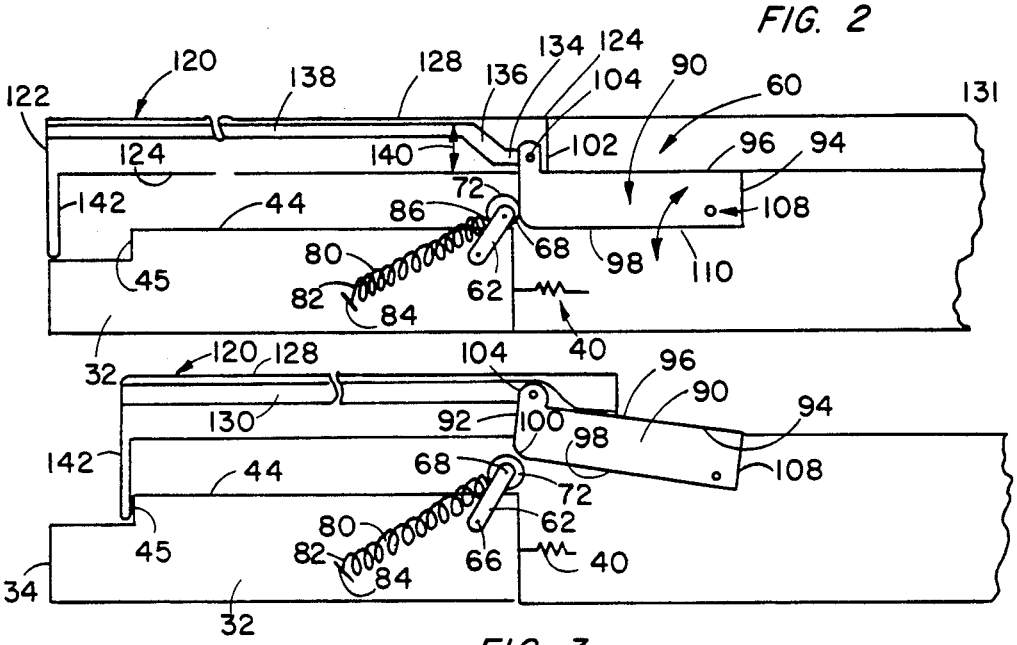
FIG. 3
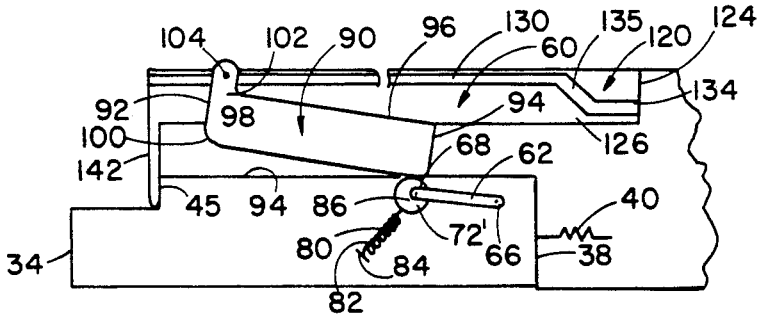
FIG. 4
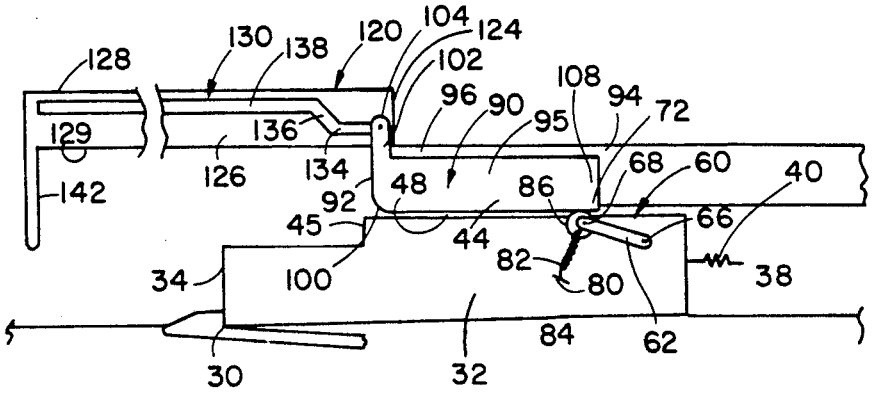
FIG. 5

SECONDARY RECOIL ABSORPTION MECHANISM FOR USE ON A FIREARM

This is a continuation of copending application Ser. No. 07/669,948 filed on Mar. 15, 1991, now abandoned.

BACKGROUND OF THE INVENTION

Application 07/699,948 is a continuation-in-part of application Ser. No. 07/542,007, filed on Jun. 22, 1990 and titled "Recoil system for devices having a reciprocating element", which was a continuation-in-part application of application Ser. No. 07/161,195 filed on Feb. 6, 1988 now U.S. Pat. No. 4,938,116, titled "Recoil System for Weapons with a Reciprocating Breech Block," which was a continuation-in-part application of application Ser. No. 040,129 filed on Apr. 20, 1987 now abandoned, titled "Rapid Fire Weapon," and is now abandoned. As such, the disclosures of these patent applications are all incorporated herein by reference.

TECHNICAL FIELD OF THE INVENTION

The present invention relates to the general art of firearms, and to the particular field of breach block recoil control systems, and, specifically, to an improvement in the recoil system disclosed in U.S. Pat. No. 4,938,116 issued on Jul. 03, 1990.

Many firearms, especially hand-held automatic firearms, have problems with accuracy due to the kick back of the weapon during firing. The kick back is caused by the block used to cover the breech chamber recoiling against some portion of the weapon frame after firing a round of ammunition. Gases associated with the explosion of the ammunition impact the breech block and cause that block to undergo recoil movement.

The gas impact force on the breech block is dissipated by the inertia forces associated with the breech block, friction forces associated with the recoil movement of the breech block, plus any primary recoil absorption mechanism of the weapon. Such primary recoil mechanisms generally include a strong spring seated against the block with that spring resisting recoil movement of that block.

The recoil movement of the breech block has been the subject of several designs which are intended to control such movement. However, such efforts have not been entirely successful. This lack of success has been most evident in automatic hand held weapons that can fire in an extremely rapid manner, e.g., firing rates of as much as 1000 rounds per minute. In fact, such weapons may have accuracy ratings (e.g., probability of hit) of as low as ten percent. That is, approximately ten percent of the rounds fired by such weapons under certain short burst conditions fall within an acceptable distance with respect to a target.

As was recognized in the inventor's prior patents and disclosures, full control of the breech block recoil movement is necessary to ensure the most accurate and controllable weapon possible. The recoil control mechanisms prior the present inventor's disclosures did not fully, reliably and accurately control breech block recoil movement, especially for ammunition that may have charges that vary in strength between rounds of ammunition. For example, if a breech block recoil absorption mechanism is set for an average charge, a weak charge may cause the weapon to jam because the block may not be moved far enough to undergo its full cycle of operation. On the other hand, however, if the recoil absorption system is set for an average charge, a strong charge may damage the weapon or the elements thereof, or cause such a strong kick back of the weapon that an already poor accuracy rating is made even worse.

The breech block control system disclosed in the inventor's prior patents and disclosures, is embodied in a breech block recoil movement control system that can be used in such hand held automatic weapons and is capable of accommodating widely varying ammunition charges while still virtually eliminating kickback effects associated with prior weapons. This design includes a secondary recoil absorption mechanism that co-operates with the primary recoil control mechanism during part of the recoil and return movements of the breech block while permitting the primary recoil absorption mechanism to control the movement of the breech block at other times. Specifically, the secondary recoil absorption mechanism acts on the breech block in co-operation with the primary recoil absorption mechanism of the weapon immediately after a round of ammunition has been fired, then drops out of controlling contact with the breech block after that block has moved a predetermined distance away from a breech covering position, and then recontacts the breech block in co-operation with the weapon primary recoil control mechanism after a preset amount of movement of the breech block along its return path to a breech-covering position.

While this breech block recoil movement control system is successful, even this design can be improved.

For example, the inventor's secondary recoil control system includes a roller mounted on a lever, with the roller engaging the rear end of the breech block. The lever is mounted on a spring-biased yoke-like element. The secondary recoil mechanism thus includes several elements that are positioned in a manner that may limit the amount of miniaturization possible for the weapon. Also, debris associated with the weapon may tend to accumulate in an area that happens to be deleterious to the smooth operation of the secondary recoil mechanism.

While the inventor's recoil control mechanism is amenable to multiple stage recoil movement control, each stage has several moving elements. The more moving elements included in a weapon of this type, the more difficult field stripping and miniaturization become. Increasing the number of elements included in a weapon of this type also may have adverse effects on reliability and weapon weight.

Still further, while the inventor's recoil control system has features that permit the weapon to be much lighter than other weapons while still enabling the weapon to be built in a manner that reduces the possibility of damage to the weapon, these features also can be further improved.

Still further, while being a significant improvement, even the inventor's own mechanism must be machined. Machining associated with weapons of this sort can be difficult and expensive under any circumstances. Therefore, there is room for improving the inventor's prior mechanism by improving the ability thereof to be machined in a process that is less expensive and more efficient than the machining process used in the prior mechanism.

OBJECTS OF THE INVENTION

It is a main object of the present invention to provide a system for controlling the recoil movement of a breech block in a firearm which is an improvement over the inventor's prior breech block movement control systems, as evidenced in disclosures such as U.S. Pat. No. 4,938,116.

It is another object of the present invention to provide full control of the recoil movement of a breech block in a firearm.

It is another object of the present invention to provide accurate control of the recoil movement of a breech block in a firearm.

It is another object of the present invention to provide full and accurate control of the recoil movement of a breech block in a firearm, even if an ammunition charge is non-average.

It is another object of the present invention to provide full and accurate control of the recoil movement of a breech block in a firearm using few elements.

It is another object of the present invention to provide full and accurate control of the recoil movement of a breech block in a firearm using few elements which are spaced from a position in which debris associated with weapon operation may subject such elements to damage.

It is another object of the present invention to provide a recoil control system for the breech block which will permit the weapon to be fabricated of light weight materials.

It is another object of the present invention to provide a recoil control system for the breech block which will permit the weapon to be fabricated of light weight materials, such as aluminum.

It is another object of the present invention to provide a recoil control system for the breech block which will permit the weapon to be fabricated of light weight materials in an efficient manufacturing process.

SUMMARY OF THE INVENTION

These, and other, objects are achieved by a secondary breech block recoil movement controlling mechanism which cooperates with a primary recoil movement mechanism in a manner similar in principle to the inventor's prior systems; however, which includes a roller mounted on the breech block and which rollingly engages a ramp portion of a camming element mounted on the weapon frame adjacent to the breech block movement path. The roller element engages the camming element when the breech block is positioned over the weapon breech, and then moves out of block movement controlling contact with the camming element after the breech block has moved a prescribed distance away from the breech covering position along a recoil path. The secondary recoil movement control mechanism of the present invention co-operates with the primary block recoil movement control mechanism during this initial phase of movement of the breech block. The roller re-engages the camming surface in a block-movement controlling manner just prior to the breech block moving back into a breech covering position during the return movement of that breech block during the firing cycle. When the roller is out of block movement controlling contact with the camming element, the primary block recoil movement controlling mechanism is essentially the sole mechanism influencing the movement of the breech block.

The camming surface includes a rounded corner against which the roller abuts. The radius of curvature of the corner along with its position relative to the breech, are selected to co-operate with a spring element which biases the roller against the camming element to absorb the recoil momentum of the breech block associated with any selected strength of ammunition charge. Because of this design, a weak charge is not likely to jam the weapon since this weak charge will move the breech block into a position where the roller merely engages the rounded corner and the primary recoil mechanism can move the block back into the breech covering position after picking up a new round of ammunition; whereas, a strong charge is not likely to cause damage to the weapon or induce an unduly large weapon kickback since the secondary recoil mechanism can absorb nearly all of the charge force and the primary recoil mechanism will absorb the rest of that force.

Alternative forms of the mechanism include means of adjusting the secondary recoil mechanism to accommodate even a wider variation in ammunition charge. These alternative forms include mechanisms to adjust the spring force as well as mechanisms for adding further rounded portions to the camming element.

The use of a roller on a camming surface reduces the total number of elements used in the secondary recoil control mechanism while permitting the overall weapon to be efficiently fabricated out of lightweight materials, such as aluminum. The breech block, itself, along with the camming element surface against which the roller abuts, can be fabricated out of steel or other such material. In this manner, the overall weapon can be lightweight; however, those portions of the weapon that are subject to wear can be formed of strong materials. The lightweight materials can be easily machined, and the simple design of the camming element and roller reduces the number of elements and simplifies the shape and nature of the elements that are present as compared to other block recoil control systems, even the inventor's own prior mechanism.

Locating the roller on the breech block itself locates the roller and the associated elements in a position that is not likely to be subjected to debris from the firing process.

BRIEF DESCRIPTION OF THE DRAWING FIGURES

FIG. 2 illustrates the secondary recoil controlling mechanism in the pre-cocked configuration.

FIG. 3 illustrates the secondary recoil controlling mechanism in the pre-cocked configuration.

FIG. 4 illustrates the secondary recoil controlling mechanism in the cocked configuration.

FIG. 5 illustrates the secondary recoil controlling mechanism in the cocked, firing configuration.

DETAILED DESCRIPTION OF THE PREFERRED EMBODIMENT OF THE INVENTION

Figure 1:
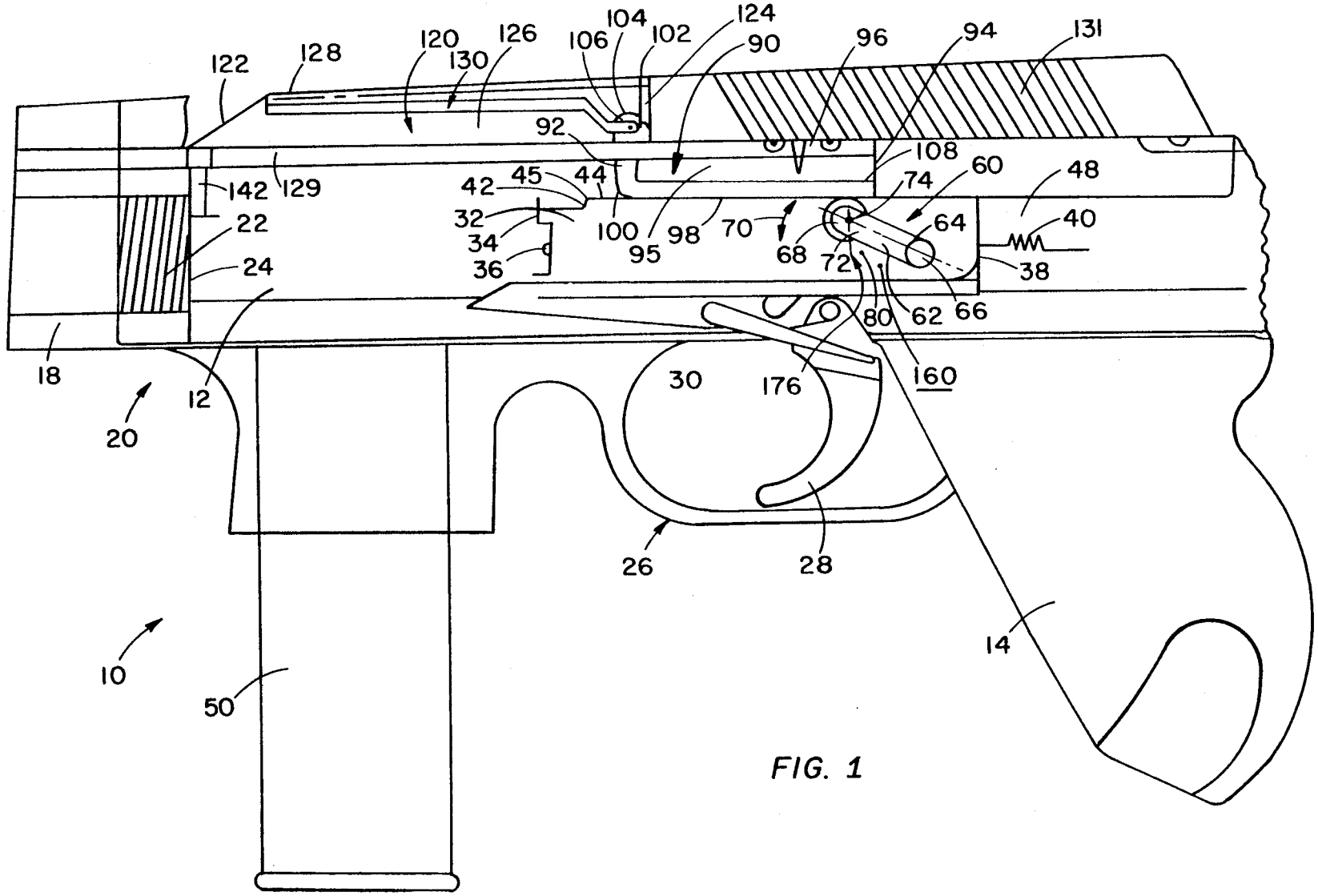
FIG. 1 is a partially cutaway side elevational view of a hand held firearm incorporating a secondary recoil controlling mechanism embodying the present invention.
Figure 6:
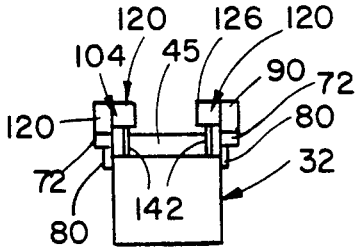
FIG. 6 is a front end elevational view of the secondary recoil controlling mechanism.

Shown in FIG. 1 is a hand held firearm 10 that is capable of automatic or semi-automatic operation and which can fire in an extremely rapid manner. The firearm is similar to the firearm disclosed in the parent applications, and includes a frame 12 having a handle 14 on a rear end 16 thereof and a barrel 18 on a front end 20 thereof. A shell-receiving chamber 22 includes a breech 24 located on the rear end of the barrel. While the firearm 10 is shown as being a closed-bolt type, it is understood that the present invention is equally applicable to an open-bolt type firearm as well.

A trigger mechanism 26 is mounted on the frame adjacent to the handle, and includes a trigger 28 operatively connected to a sear 30 to move that sear into and out of a position in which a breech block 32 is held for firing. The breech block includes a front end 34 having a firing pin 36 mounted thereon, a rear end 38 against which a primary recoil mechanism, indicated by spring 40, is engaged, sidewalls 42 and a top surface 44 connecting the front end to the rear end. The breech block includes a shoulder 45 extending across the block between the sidewalls and which is spaced from the front end 34 of the block. The breech block is mounted within a frame receiver section 48 to reciprocate between a closed position with the front end 34 seated against the breech and a retracted position uncovering the breech. The primary recoil absorption mechanism normally biases the breech block toward the closed position and such bias is overcome by the sear 30, as well as the action of the gases generated by the firing of a round of ammunition as discussed in the inventor's prior disclosures.

Automatic operation of the firearm is achieved by simply holding the trigger in position to move the sear out of the path of the breech block. The breech block picks up a fresh round from an ammunition storage and feeding element 50, moves that fresh round into the firing chamber of the weapon, and fires that round when the firing pin contacts the round. The round generates gases upon firing, and these gases impact the breech block to drive that block back in a recoiling motion toward the rear end of the frame. The recoil motion generating forces associated with the impact of the expanding gases on the breech block are absorbed by the inertia of the breech block, the friction between the block and the frame as the block moves in the recoil motion, and the primary recoil absorption mechanism 40. Once the breech block has been brought to rest by these forces, the bias on that block associated with the primary recoil absorption mechanism forces the block back in a return motion toward the forward end of the frame. If the sear is out of the path of the block, the block simply continues past the position shown in FIG. 1, picks up the next round of ammunition from the element 50, moves that new round into the firing chamber and repeats the cycle of operation until the ammunition in element 50 is exhausted. As discussed in the prior disclosures, especially in U.S. Pat. No. 4,938,116, the firearm includes suitable systems for ejecting spent cartridges. The disclosure of such patent is therefore incorporated herein for such discussion.

The mechanism embodying the present invention is best shown in FIGS. 1-6 and is embodied in a secondary recoil absorption mechanism 60. This secondary recoil absorption mechanism acts in a manner similar to the operation of the secondary recoil absorption mechanisms discussed in the inventor's prior disclosures, and such discussions are incorporated herein by reference. The secondary recoil absorption mechanism 60 operates in conjunction with the primary recoil absorption mechanism 40 to absorb recoil energy during the initial phase of the breech block recoil, that is that phase of the recoil which occurs immediately after the round of ammunition has been fired. After this initial phase of the recoil movement has been completed, the secondary recoil absorption mechanism drops out of breech block movement controlling engagement with the breech block, and leaves the primary recoil absorption mechanism as the sole means for absorbing the recoil energy. The secondary recoil absorption mechanism re-establishes block movement controlling engagement with the block just prior to the block reaching its closed position with the front end 34 of the block in abutting engagement with the rear end of the barrel. As discussed in these prior disclosures, the force of the expanding gases on the breech block is great enough to move the breech block in a recoil motion, even against the combined effects of the block inertia, the secondary recoil absorption mechanism and the primary recoil absorption mechanism. However, the inertia of the block combined with the force associated with the secondary recoil absorption mechanism holds the block in the breech closing position. Once that inertia is overcome, the block will move on the recoil path.

As discussed in the inventor's prior disclosures, such secondary recoil absorption mechanism permits the firearm to operate smoothly, and accurately while firing in an extremely rapid manner, and permits the firearm to absorb all, or nearly all, of the recoil energy associated with the firing of the weapon. This secondary recoil absorption mechanism can be set to absorb as much energy as desired so that variation between rounds can be accommodated without jamming the weapon or causing undue kickback. The elimination of kickback increases the accuracy of the firearm.

As is best shown in FIGS. 1-6, the secondary recoil absorption mechanism includes a lever element 62 having a first end 64 pivotally mounted on the sidewall of the breech block near the rear end 38 of that block by a pivot pin 66. The lever element has a second end 68 which rotates around the pivot pin in the clockwise and counterclockwise directions as indicated in FIG. 1 by the double-headed arrow 70 between a first position spaced beneath the block top surface 44 as shown in FIGS. 1, 4 and 5, and a second position having the end 68 located adjacent to or just above the block top surface 44 as shown in FIG. 4. A roller element 72 is rotatably mounted on the lever element second end 68 by an axle 74 to rotate around such axle in the directions indicated by arrow 70.

A compression spring element 80 has one end 82 thereof seated on the breech block by a spring seat 84, and has another end 86 thereof engaged with the lever element between the lever element ends 64 and 68. The spring 80 biases the lever element toward the first position of that lever element. The spring end 86 can be attached to the lever element at the axle 74 if suitable.

A ramp element 90 is mounted on the frame 12 adjacent to the breech block. The ramp element has a front end 92, a rear end 94, sidewalls 95, a top surface 96 and a ramp surface 98. The ramp surface is located adjacent to the breech block top surface 44, and the ramp element front end is connected to the ramp surface by a corner 100 that is rounded from the front end toward the rear end to be convex with respect to the breech block front end 34.

The ramp element further includes a nose element 102 extending upwardly above the top surface 96 and which includes a roller 104 mounted thereon by an axle 106. In the preferred embodiment, the roller extends slightly inwardly from a plane containing the sidewall of the breech block. However, in another form of the invention, the roller can extend completely across the width of the breech block. The purpose of the ramp element will be discussed below, and it is pivotally mounted on the frame by a pivot pin 108 located near the intersection of the rear end 94 and the ramp surface 98. The pivot pin is fixed at each end thereof to a frame sidewall and extends widthwise across the frame from one sidewall to the other sidewall. The ramp element pivots about the pivot pin in the directions indicated by the double-headed arrow 110 in FIG. 2 between a first position with the ramp surface 98 extending along the path followed by the breech block during its recoil movement and which is shown in FIGS. 1, 2 and 5, and a second position with the ramp surface oriented at a skewed angle with respect to such block movement path, as shown in FIGS. 3 and 4.

When the ramp element is in the first position, the rounded corner 100 is in position to abut the roller element 72. This abutting contact between the roller element and the ramp element acts as a resistance to the rearward, recoil, movement of the breech block. When the ramp element is in the second position, the rounded corner is spaced above the roller element 72, thereby clearing the path for that roller element to move rearwardly of the frame as the breech block moves along the recoil path without abutting the ramp element front end.

It is noted that the spring force of the spring 80 is set such that manual force is not sufficient to move the breech block along its recoil path when the roller is engaged against the rounded corner. However, when the ramp element is in the second position, the angle between the roller element 102 and the ramp surface 98 at the location of contact between that roller and the ramp surface is such that manual force on the breech block will be sufficient to move the breech block along its recoil path. The difference between the positions of the lever element changes the lever arm length acting on the spring element and the angle of such action sufficiently to permit such manually activated movement when the roller element abuts the ramp surface 98 instead of the rounded corner 100. The purpose of this difference in action based on position of the roller relative to the ramp element will be understood from the following discussion.

The secondary recoil absorption mechanism 60 further includes a cocking lever 120 slidably mounted on top of the frame 12 adjacent to the ramp element. The cocking lever 120 includes a forward end 122, a rear end 124, sidewalls 126, a top surface 128 and a bottom surface 129. Suitable rails, bushings, and the like are used to mount the cocking lever on the frame. The cocking lever also includes a longitudinal axis extending from the rear end to the front end thereof. A handgrip element 131 is also slidably mounted on the frame 12. The handgrip element is connected to the cocking lever to move that lever toward the forward end of the frame or toward the rear end of the frame. Again, suitable rails, bushings or the like are used to connect the handgrip element to the frame and to the cocking lever. The preferred form of the secondary recoil absorption mechanism includes two cocking levers, one on each side of the frame superadjacent to the breech block. Each cocking lever includes a multi-section groove 130 defined in the sidewall thereof which faces sidewardly outward of the frame. An alternative form of the secondary recoil absorption mechanism includes a single cocking lever, with a single groove defined therethrough widthwise thereof, with a single roller element extending through the single groove for the entire width of the cocking lever.

The groove 130 includes a first section 134 which extends along the cocking lever longitudinal axis parallel to the path of breech block recoil movement from the rear end of that cocking lever towards the front end thereof. A second section 136 is connected at one end thereof to the front end of the first section and extends at a skewed angle with respect to the cocking lever longitudinal axis upwardly from toward the top surface 128. The second groove section has a second end connected to a rear end of a third section 138 of the groove. The third groove section extends along the cocking lever longitudinal axis toward the front end of the cocking lever and is parallel to the breech block recoil path. The third section 138 is spaced upwardly toward the top surface 128 with respect to the first section and is parallel to that first groove section. The spacing between the first and third sections is indicated in FIG. 2 by arrow 140.

The cocking lever 120 slidably moves between a first position with the front end 122 thereof adjacent to the barrel as shown in FIGS. 1, 2 and 5, and a second position with the front end thereof spaced toward the rear end of the frame from the first position as shown in FIG. 4. The cocking lever includes a breech block engaging element 142 depending from the bottom surface 129 thereof at the front end 122 thereof. The block engaging element 142 is sized and located to engage the breech block shoulder 45 and move that breech block along the recoil path as the cocking lever is moved rearwardly towards the rear end of the frame.

The ramp element 104 is engaged in the cocking lever groove 130. As the cocking lever is moved rearwardly toward the rear of the frame, the roller 104 is forced to follow the groove 130. Thus, as the cocking lever is moved rearwardly from the FIG. 2 position, the roller 104 moves along the first groove section 134 from engagement in the first groove section 134 into engagement with the second groove section 136, then moves along the second groove section 136 into engagement with the third groove section 138. The roller 104 finally moves through the third groove section 138 toward the cocking lever front end 122. Reverse movement of the cocking lever from the rear position towards the front of the frame reverses this just-described roller movement with respect to the groove 130.

The ramp element 90 is connected to the roller 104, and thus moves in correspondence with such roller movement. Thus, the ramp element 90 moves from its first position shown in FIG. 2 to the second position shown in FIGS. 3 and 4 as the roller 104 moves from the first groove section 134 to the second groove section 136 and, finally, into the third groove section 138.

Operation of the secondary recoil absorption mechanism 60 will be understood by referring to FIGS. 2–5. FIG. 2 illustrates the mechanism 60 in a pre-cocked condition with the breech block 32 in its closed position, the lever element 62 in its second position, the cocking lever 120 in its first position, and the ramp element 90 in its first position. In such pre-cocked configuration, the roller element 72 is abuttingly engaged with the rounded corner 100, and manual force will not be sufficient to move the breech block in its recoil movement. The projection 142 is spaced from the breech block shoulder 45.

The firearm is initially cocked by moving the cocking lever 120 from the FIG. 2 position toward the rear of the firearm. This can be accomplished manually. As the cocking lever is moved rearwardly toward its second position, the roller 104 is forced to follow the groove sections of groove 130. As this roller 104 moves through the various groove sections, the ramp element 90 is lifted from the first position shown in FIG. 2 to the second position shown in FIG. 3. This lifting action moves the rounded shoulder 100 out of the path of the roller element 72 whereby the roller element 72 can move past the rounded shoulder 100 without engaging that shoulder or the front end 92 of the ramp element 90. The first time the roller element engages the ramp element will be when the roller element 72 engages the ramp surface 98. As discussed above, when the roller element 72 engages the ramp surface 98 in such a position and relative orientation of these two elements, the angles and lever arms are sufficient to overcome the biasing force associated with the spring 80, and very little force is required to move the lever arm 62 from the second position shown in FIG. 2 to the first position shown in FIG. 4 against the bias of the spring 80.

This rearward movement of the cocking lever eventually moves the projection 142 into engagement with the breech block shoulder 45 as indicated in FIG. 3. Such engagement between the projection 142 and the shoulder 45 couples the breech block to the cocking lever. Continued rearward movement of the cocking lever causes the breech block to move with the cocking lever along the recoil path of the breech block toward the rear end of the firearm. Since the ramp element 90 is in its upward position, the engagement between the roller element 72 and the ramp surface 98 does not generate forces which are sufficient to prevent further rearward movement of the breech block and the cocking lever.

Continued rearward movement of the cocking lever eventually moves the breech block into a position to have the sear 30 engage the front end 34 of the breech block 32 and lock that breech block into a position spaced from the breech of the firearm. The rearward movement of the breech block is resisted by the primary recoil absorption mechanism 40 which biases the breech block toward the closed position.

The cocking lever is then manually moved forward toward the front end of the frame. This forward movement of the cocking lever leaves the breech block in the FIG. 5 location since the sear 30 prevents forward movement of the breech block. As the cocking lever moves forward toward the front of the frame, the roller 104 moves rearwardly along the groove third section 138 toward the cocking lever rear end 124, then downwardly and rearwardly as it moves into and through the second groove section 136, and, finally rearwardly as it moves into and through the groove first section 134. This roller movement causes the ramp element 90 to move downwardly from the second position thereof shown in FIG. 3 to the first position thereof shown in FIG. 5.

However, in the FIG. 5 configuration, the roller element 72 contacts the ramp surface 98 rearwardly of the rounded corner 100 and thus does not significantly influence the movement of the breech block.

Operation of the trigger mechanism releases the breech block from the sear, and the primary recoil absorption mechanism forces the breech block forward toward its closed position. As the breech block moves forwardly from the FIG. 5 position, it picks up a fresh round of ammunition, and forces that fresh round into the breech. As soon as the breech is closed with the fresh round of ammunition therein, the firing pin 36 contacts the ammunition in a manner which fires that round of ammunition.

As soon as the ammunition is fired, gases are generated. These gases impact the breech block and tend to force that block backwards toward the rear of the frame in the recoil movement of the block. As discussed above, this recoil movement is resisted by the combined action of the inertia of the block, the primary recoil absorption mechanism and the secondary recoil absorption mechanism. The secondary recoil mechanism has the roller 72 engaged against the rounded corner 100 when the ammunition round is fired. The angle established between the lever arm 62 and the spring 80, combined with the location of the connection of the spring to the lever arm 62 creates a force relationship which makes it extremely difficult for the gases associated with the explosion of the ammunition round, which act along the longitudinal axis of the breech block essentially perpendicular to the front end of the breech block, to overcome the resisting force associated with the spring 80 on the lever arm 62 via the roller. However, these impact forces are sufficient to move the block along its recoil path. The inertia forces associated with mass of the breech block and the secondary recoil mechanism hold the block stationary for an instant before the block begins to recoil under the influence of the expanding gases in the breech chamber, even when those forces have slightly decayed. However, because the roller engages the rounded corner, the forces causing the breech block to recoil are dissipated by the forces associated with moving the roller around the rounded corner. Thus, the ultimate recoil forces acting on the breech block are much reduced in the firearm 10 as compared to other weapons which do not include a secondary recoil absorption mechanism and which exclusively rely on the primary recoil mechanism to absorb the recoil forces and energies.

Automatic operation of the firearm is achieved by simply holding the trigger mechanism in a position which keeps the sear from engaging the breech block. In such a condition, the block will simply move backwards under the influence of the expanding gases, and then forwards under the influence of the primary recoil mechanism. The forward, or return, movement of the breech block is not adversely affected by the secondary recoil absorption mechanism since the roller element 72 is in contact with the ramp surface 98 and simply rolls along this surface until it moves forwardly of the rounded corner far enough to move upwards toward the top surface of the firearm and back into the FIG. 2 configuration.

Figure 9:
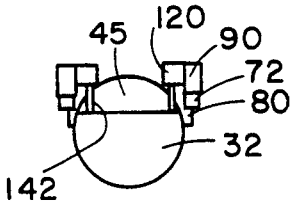
FIG. 9 is a front end elevational view of an alternative form of the breech block having a secondary recoil controlling mechanism mounted thereon.

An alternative form of the breech block is shown in FIG. 9. The alternative breech block 32' is cylindrical whereby circular and cylindrical shapes can be used for the firearm and the elements thereof associated with the breech block. The cylindrical shape of the breech block expedites machining operations associated with the firearm.

Figure 10:
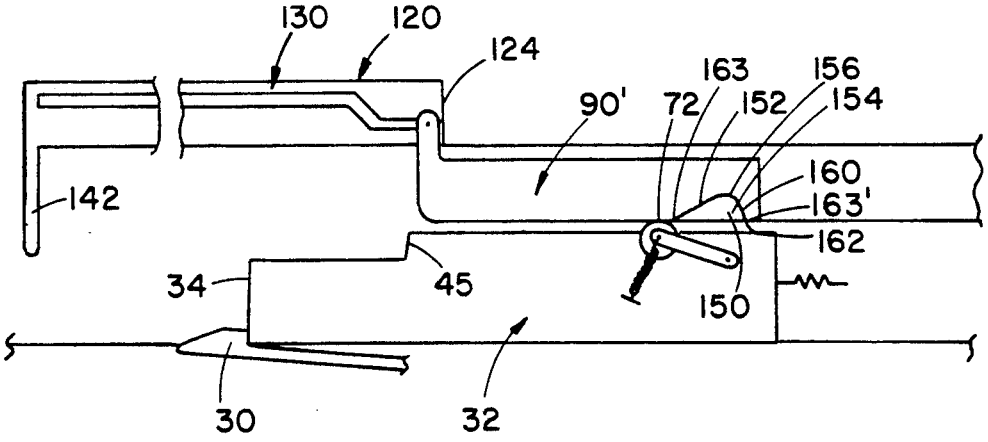
FIG. 10 is an alternative form of the secondary recoil controlling mechanism in which multiple stages of recoil control are included.

A further form of the secondary recoil absorption mechanism is shown in FIG. 10. As shown in FIG. 10, an alternative ramp element 90' includes a concave groove 150 defined therein adjacent to the rear end thereof. The groove 150 includes an arcuate ingress surface 152, an arcuate egress surface 154 and a connecting surface 156. The ingress surface is curved along one radius of curvature, and the egress surface is curved along two or more radii of curvatures. The egress surface thus includes a first section 160 and a second section 162. The surfaces are interconnected in such a manner that the roller moves through the groove 150 smoothly without impacting the surfaces in a manner which jolts the firearm. Curved corners, such as corners 163 and 163', are included to further ensure smooth movement of the roller element 72 into and through the groove 150. The egress surface acts on the roller in a manner identical to the manner of rounded corner 100 thereby inhibiting recoil movement of the breech block. The ingress surface is shaped to permit the force on the breech block associated with the primary recoil absorption mechanism to move the breech block back along its return path even while the roller element 72 engages the ingress surface. If suitable, more than one groove element 150 can be included in the ramp element. This will provide a multiple stage recoil absorption feature.

Figure 7:
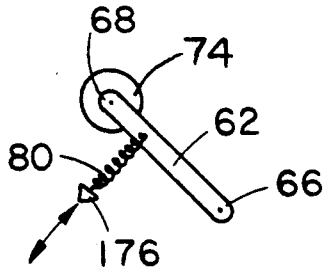
FIG. 7 illustrates a portion of the secondary recoil controlling mechanism.
Figure 8:
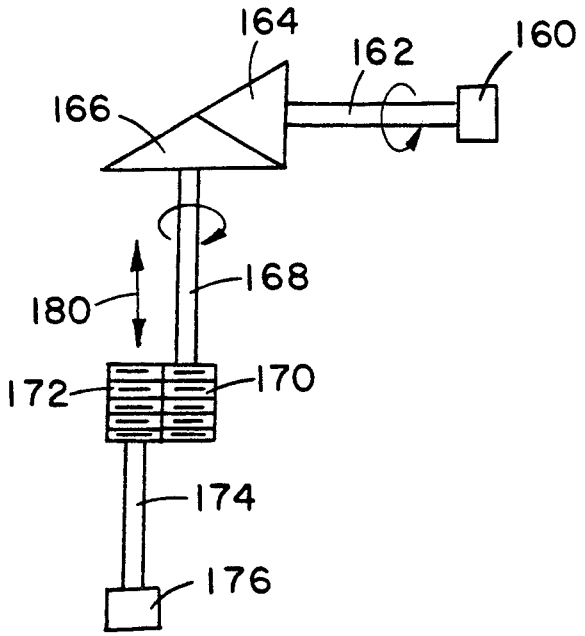
FIG. 8 illustrates a mechanism for adjusting the secondary recoil controlling mechanism.

A further feature of the secondary recoil absorption mechanism can include a mechanism for adjusting the amount of force associated with the spring 80. This adjustment will permit the secondary recoil absorption mechanism 60 to accommodate different charge strengths, and be adjusted as necessary. The adjusting means is best shown in FIGS. 1, 7 and 8 in which a knob 160 is mounted on the frame of the firearm. The knob 160 can be removed from the frame and connected as necessary. The knob is mounted at one end of a first shaft 162 that is inserted through an opening in the frame when the adjusting means is to be used. A bevel gear 164 is located in the breech block and has a keyway defined centrally thereof. A bore is also defined in the breech block to be aligned with the frame opening to permit the shaft 162 to be inserted through the aligned opening and the bore when the breech block is in a selected position. The shaft 162 has a key on the end thereof remote from the knob, and such key is received in the keyway to couple the shaft 162 to the gear 164 so the gear will rotate when the knob is turned. The gear 164 is meshingly engaged with a second bevel gear 166 located internally of the block, and a second shaft 168 is attached at one end thereof to the second bevel gear for rotation therewith. A worm element 170 is located in the block and is mounted on the second shaft for rotation therewith. The worm element 170 is engaged with a second worm element 172 also located in the block so the second worm element rotates in conjunction with the second shaft 168. The second worm element is mounted on a third shaft 174 that has a spring mount 176 on the end thereof remote from the second worm element. Rotation of the knob is transferred to the spring mount to move that mount linearly as indicated in FIG. 8 by the double-headed arrow 180. The third shaft is located in a bore defined in the breech block. The breech block bore accommodating the third shaft 174 and the second worm element 172 is sized so those two elements can move as indicated by arrow 180. The spring mount 176 is also movably mounted on the breech block, as by keys on the spring mount engaged in keyways in the breech block. The spring mount 176 is mounted on the block to engage the end of the spring 80 that is remote from the lever arm 62 as indicated in FIG. 7. Movement of the spring mount adjusts the spring force of the spring 80 exerted on the lever arm 62 to adjust the amount of force required to throw that lever arm from the FIG. 2 position into the FIG. 4 position. This permits a user to adjust the reaction of the firearm to various ammunition charges.

It is understood that while certain forms of the present invention have been illustrated and described herein, it is not to be limited to the specific forms or arrangements of parts described and shown.

I claim:

1. In a firearm of the type having a frame and a receiver, a barrel mounted on the frame and having a shell-receiving chamber with a breech that is located adjacent to a rear end of the barrel, a round of ammunition being inserted into the shell-receiving chamber for firing with ammunition firing imparting recoil energy into the breech, means for positioning a new round of ammunition for insertion into the breech, a breech block having sidewalls, a top surface, a front end and a rear end, the breech block being housed within the receiver and undergoing reciprocating movement along a reciprocating movement path between a closed position with the breech block front end seated against the breech and a retracted position with the breech block front end uncovering the breech, the breech block executing a recoil movement when moving from the block closed position to the block retracted position and a return movement when moving from the block retracted position back to the block closed position, and a primary recoil absorption means which includes a spring normally biasing the breech block toward the block closed position and which is operative during the recoil movement of the breech block away from the block closed position to absorb at least a portion of recoil energy associated with firing of the round of ammunition, the improvement in combination therewith comprising: secondary recoil absorption means which immediately after said firing is in movement-controlling engagement with the breech block and cooperates with the primary recoil absorption means to control the recoil movement of the breech block as said breech block moves away from the breech and then becomes essentially inactive with respect to controlling movement of the breech block and then moves back into movement-controlling contact with the breech block and once again cooperates with the primary recoil absorption means, the secondary recoil absorption means including:

(1) a lever element having a first end pivotally mounted on the breech block and a second end;

(2) a spring element connected at one end thereof to the breech block and at a second end thereof to said lever element, said spring element biasing said lever element second end towards a position spaced above said breech block top surface;

(3) a roller element rotatably mounted on said lever element;

(4) a ramp element having
(a) a first end,
(b) a second end,
(c) a guide element mounted on said ramp element second end,
(d) a rounded corner on said ramp element second end,
(e) said ramp element being positioned in the receiver to locate said rounded corner adjacent to said roller element,
(f) a ramp surface connecting said rounded corner to said ramp element first end,
(g) pivot means connecting said ramp element first end to said receiver, said ramp element pivoting about said pivot means between a first position with said rounded corner located to be abutted by said roller element and a second position with said ramp element surface oriented at a skewed angle with respect to the breech block top surface;

(5) a cocking lever having
(a) a front end,
(b) a rear end,
(c) a block engaging element on said cocking lever front end,
(d) a guide groove defined in said cocking lever, said guide groove including
(i) a first section extending from said cocking lever rear end toward said cocking lever front end along the breech block reciprocating movement path,
(ii) a second section extending at a skewed angle with respect to the breech block reciprocating movement path and extending from said first section toward said cocking lever front end, and
(iii) a third section extending from said second section toward said cocking lever front end along the breech block reciprocating movement path, said third section being spaced from said first section;

(6) said ramp element guide element being movably located in said cocking lever guide groove; and (7) means for movably mounting said cocking lever on the frame to move between a first position with said ramp element guide element positioned in said groove first section and a second position with said guide element positioned in said groove third section.

2. The improvement defined in claim 1 further including a shoulder on the breech block, said breech block shoulder being positioned to be engaged by said cocking lever block engaging element when said cocking lever is moved from said first position to said second position.

3. The improvement defined in claim 2 wherein said lever element is positioned to extend from said lever element second end at an angle which is skewed with respect to the breech block reciprocating movement path toward the breech block rear end when said roller element engages said ramp element rounded corner.

4. The improvement defined in claim 2 further including adjusting means for adjusting spring force associated with said secondary recoil absorption means spring element.

5. The improvement defined in claim 4 wherein said adjusting means includes an adjusting knob rotatably mounted on the breech block, a first shaft connected at one end thereof to said knob for rotation therewith, a first bevel gear mounted on another end of said first shaft for rotation therewith, a second bevel gear meshingly engaged with said first bevel gear for rotation therewith, a second shaft connected at one end thereof to said second bevel gear for rotation therewith, a first worm element mounted on said second shaft for rotation therewith, a second worm element meshingly engaged with said first worm element, a third shaft connected at one end thereof to said second worm element for rotation therewith, a spring mount element mounted on said third shaft for movement therewith, said secondary recoil absorption means spring element one end being connected to said adjusting means spring mount.

6. In a firearm of the type having a frame and a receiver, a barrel mounted on the frame and having a shell-receiving chamber with a breech that is located adjacent to a rear end of the barrel, a round of ammunition being inserted into the shell-receiving chamber for firing with ammunition firing imparting recoil energy into the breech, means for positioning a new round of ammunition for insertion into the breech, a breech block having sidewalls, a top surface, a front end and a rear end, the breech block being housed within the receiver and undergoing reciprocating movement along a reciprocating movement path between a closed position with the breech block front end seated against the breech and a retracted position with the breech block front end uncovering the breech, the breech block executing a recoil movement when moving from the block closed position to the block retracted position and a return movement when moving from the block retracted position back to the block closed position, and a primary recoil absorption means which includes a spring normally biasing the breech block toward the block closed position and which is operative during the recoil movement of the breech block away from the block closed position to absorb at least a portion of recoil energy associated with firing of the round of ammunition, the improvement in combination therewith comprising: secondary recoil absorption means which immediately after said firing is in movement-controlling engagement with the breech block and cooperates with the primary recoil absorption means to control the recoil movement of the breech block as said breech block moves away from the breech and then becomes essentially inactive with respect to controlling movement of the breech block and then moves back into movement-controlling contact with the breech block and once again cooperates with the primary recoil absorption means, the secondary recoil absorption means including:

(1) a manually operated cocking lever mounted on the frame to move between a first position adjacent to the barrel and a second position spaced from said first position along the breech block reciprocating movement path;

(2) a ramp means mounted on the receiver to move between a first position extending along the breech block reciprocating movement path and a second position at a skewed angle with respect to the breech block reciprocating movement path, said ramp means including a front end and a ramp surface;

(3) guide means connecting said ramp means to said cocking lever and moving said ramp means into said ramp means first position when said cocking lever is in said cocking lever first position and moving said ramp means into said ramp means second position when said cocking lever is in said cocking lever second position;

(4) a lever element mounted at one end thereof on the breech block and having a roller element on another end thereof, said lever element moving between a fist position having said roller element spaced beneath the breech block top surface when the breech block is in the block retracted position and a second position having said roller element located above the breech block top surface to abut said ramp means front end when the breech block is in the breech block closed position; and (5) spring means connected to the breech block and to said lever element and biasing said lever element toward said lever element second position.

7. The improvement defined in claim 6 wherein said guide means includes a guide groove defined in said cocking lever.

8. The improvement defined in claim 7 wherein said guide groove includes two parallel sections and one section intersecting both of said parallel sections and extending at a skewed angle with respect to the breech block reciprocating movement path, said guide groove two parallel sections extending parallel to the breech block reciprocating movement path.

9. The improvement defined in claim 8 wherein said ramp means includes a rounded shoulder connecting said ramp means front end to said ramp means ramp surface.

10. The improvement defined in claim 9 wherein said lever element includes said roller element being rotatably mounted on said another end thereof to engage said ramp means rounded shoulder when the breech block is in the breech block closing position and to engage said ramp means ramp surface when the breech block is in breech block retracted position.

11. The improvement defined in claim 10 further including a second groove on said ramp means ramp surface spaced from said rounded shoulder.

12. The improvement defined in claim 11 wherein said second groove includes two arcuate surfaces.

13. The improvement defined in claim 12 wherein one of said second groove arcuate surfaces includes two curved sections.

14. In a firearm of the type having a frame and a receiver, a barrel mounted on the frame and having a shell-receiving chamber with a breech that is located adjacent to a rear end of the barrel, a round of ammunition being inserted into the shell-receiving chamber for firing with ammunition firing imparting recoil energy into the breech, means for positioning a new round of ammunition for insertion into the breech, a cylindrical breech block, the breech block being housed within the receiver and undergoing reciprocating movement along a reciprocating movement path between a closed position with the breech block front end seated against the breech and a retracted position with the breech block front end uncovering the breech, the breech block executing a recoil movement when moving from the block closed position to the block retracted position and a return movement when moving from the block retracted position back to the block closed position, and a primary recoil absorption means which includes a spring normally biasing the breech block toward the block closed position and which is operative during the recoil movement of the breech block away from the block closed position to absorb at least a portion of recoil energy associated with firing of the round of ammunition, the improvement in combination therewith comprising: secondary recoil absorption means which immediately after said firing is in movement-controlling engagement with the breech block and cooperates with the primary recoil absorption means to control the recoil movement of the breech block as said breech block moves away from the breech and then becomes essentially inactive with respect to controlling movement of the breech block and then moves back into movement-controlling contact with the breech block and once again cooperates with the primary recoil absorption means, the secondary recoil absorption means including:

(1) a manually operated cocking lever mounted on the frame to move between a first position adjacent to the barrel and a second position spaced from said first position along the breech block reciprocating movement path;

(2) a ramp means mounted on the receiver to move between a first position extending along the breech block reciprocating movement path and a second position at a skewed angle with respect to the breech block reciprocating movement path, said ramp means including a front end and a ramp surface;

(3) guide means connecting said ramp means to said cocking lever and moving said ramp means into said ramp means first position when said cocking lever is in said cocking lever first position and moving said ramp means into said ramp means second position when said cocking lever is in said cocking lever second position;

(4) a lever element mounted at one end thereof on the breech block and having a roller element on another end thereof, said lever element moving to move between a first position having said roller element spaced beneath the breech block top surface when the breech block is in the block retracted position and a second position having said roller element located above the breech block top surface to abut said ramp means front end when the breech block is in the breech block closed position; and (5) spring means connected to the breech block and to said lever element and biasing said lever element toward said lever element second position.

* * * * *